US007921797B2

(12) United States Patent
James

(10) Patent No.: US 7,921,797 B2
(45) Date of Patent: Apr. 12, 2011

(54) BIMINI TOP

(75) Inventor: Timothy R. James, Manitowoc, WI (US)

(73) Assignee: DOWCO, Inc., Manitowoc, WI (US)

( * ) Notice: Subject to any disclaimer, the term of this patent is extended or adjusted under 35 U.S.C. 154(b) by 489 days.

(21) Appl. No.: 12/048,977

(22) Filed: Mar. 14, 2008

(65) Prior Publication Data

US 2009/0229508 A1 Sep. 17, 2009

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS

| | | | | |
|---|---|---|---|---|
| 1,289,265 | A | 12/1918 | Richard et al. | |
| 3,316,012 | A | 4/1967 | Thier | |
| 3,354,892 | A * | 11/1967 | Frieder | 114/361 |
| 3,399,687 | A | 9/1968 | Frieder | |
| 3,955,732 | A | 5/1976 | Boschen | |
| 4,683,900 | A | 8/1987 | Carmichael | |
| 5,441,066 | A | 8/1995 | Harris | |
| 5,520,139 | A | 5/1996 | King et al. | |
| 5,697,320 | A | 12/1997 | Murray | |
| 6,223,680 | B1 | 5/2001 | Frink et al. | |
| 6,763,650 | B1 * | 7/2004 | Snow | 54/71 |
| 6,968,800 | B1 | 11/2005 | Becht | |
| 7,159,530 | B1 | 1/2007 | Shearer et al. | |
| 7,210,726 | B2 | 5/2007 | Merlot, Jr. et al. | |
| 7,325,856 | B2 | 2/2008 | Merlot, Jr. et al. | |
| 2007/0095272 | A1 | 5/2007 | Shearer et al. | |
| 2007/0287614 | A1 * | 12/2007 | Fuller | 482/121 |

OTHER PUBLICATIONS

Bimini Top Retraction System (Schwintek, Inc.) as described in the background of Applicant's specification and illustrated in Fig. 1, known to be on sale or publicly available before Mar. 14, 2007.

* cited by examiner

*Primary Examiner* — Stephen Avila
(74) *Attorney, Agent, or Firm* — Michael Best & Friedrich LLP

(57) ABSTRACT

A retractable bimini top movable between stowed and deployed orientations includes a frame including a first bow and a second bow movable relative to the first bow. The retractable bimini top further includes a cover positioned over at least a portion of each of the first and second bows and a first elastic cord having a first end coupled to the first bow and a second end coupled to the second bow such that the first elastic cord is under tension at least when the retractable bimini top is in the deployed orientation. The first elastic cord has an allowable percent elongation of at least 200 percent.

12 Claims, 8 Drawing Sheets

BIMINI TOP

BACKGROUND

The present invention relates to bimini tops, which are able to be selectively deployed from a stowed position to provide shade and/or shelter for occupants of boats or other vessels or structures.

In at least one existing bimini top 20 (FIG. 1), a canvas cover 22 is attached to several bows 24 that support the cover 22 and that are pivotable relative to each other to allow retraction and extension of the bimini top 20. The bimini top 20 can be moved between a stowed position (in which the bows 24 are stacked together to minimize the storage space) and a deployed position (in which the bows 24 are spaced apart to cover a predetermined area of the boat). As shown in FIG. 1, the bimini top 20 can include main bows 24A and auxiliary bows 24B. The auxiliary bows 24B are connected directly to the main bows 24A rather than to the boat or to another designated support structure. The auxiliary bows 24B are pivotable with respect to the main bows 24A to which they are connected in order that they may also move between stacked or "stowed" positions and spaced-apart or "deployed" positions.

The bimini top 20 can be deployed and/or stowed by hand or by a powered or automated system (i.e., a hydraulic actuator). In many instances, regardless of whether the bimini top 20 is power-operated, a user may have to manually pivot the auxiliary bows 24B away from each other and towards the respective main bows 24A during retraction of the bimini top 20 in order to have them assume the proper stowed orientation. To prevent the need for manually stacking the auxiliary bows 24B, bungee cords 26 may be provided between the main bows 24A and the respective auxiliary bows 24B. Each bungee cord 26 extends from a first attachment point 28 on the auxiliary bow 24B through an opening 30 in the corresponding main bow 24A to a second attachment point 32. The bungee cords 26 are pre-tensioned by this arrangement such that there is a biasing force present to keep the auxiliary bows 24B stacked next to the respective main bows 24A when they are in the stowed position. When the bimini top 20 is deployed, the tension in the bungee cords 26 increases further, proportional to the length that they are stretched. In this arrangement, the bungee cords 26 are subject to destructive chafing at the openings 30 where the cords 26 pass though the main bows 24A, even with the use of a grommet or the like in the opening 30, due to the tensile force in the bungee cords 26 and the sharp angle that must be followed. Furthermore, the exposed portions of the bungee cords 26 are subject to damage from any number of sources including, but not limited to UV exposure and incidental contact with sharp objects. If one of the bungee cords 26 breaks, it is not contained and may release its stored energy in an unpredictable manner.

With respect to the bungee cords 26 themselves, it is known to use conventional fabric-covered latex cords, which have a maximum stretchability or allowable elongation of about 50 percent to 100 percent (i.e., stretching to a length between about 1.5 times and 2 times the nominal or unstretched length). The fabric cover or jacket encloses many elastic strands and acts as an over-stretch protector and exposure protector for the strands. These thin elastic strands combine for a particularly high amount of exposed surface area and thus, are particularly sensitive to oxygen exposure, which will ultimately harden and break down the material and make the bungee cords 26 lose their functionality. Because of the limited amount of allowable elongation percentage, a large length of the material must be used (larger than the actual distance between one of the main bows 24A and one of the auxiliary bows 24B) in order to obtain the required amount of overall elongation, which is determined by the difference in the distance between the main and auxiliary bows 24A, 24B in the respective stowed and deployed orientations. This necessitates the arrangement of having the bungee cords 26 pass inside the main bows 24A, which has certain disadvantages as discussed above.

SUMMARY

In one embodiment, the invention provides a retractable bimini top movable between stowed and deployed orientations. The retractable bimini top includes a frame having a first bow and a second bow movable relative to the first bow. A cover of the retractable bimini top is positioned over at least a portion of each of the first and second bows. A first elastic cord has a first end coupled to the first bow and a second end coupled to the second bow such that the first elastic cord is under tension at least when the retractable bimini top is in the deployed orientation. The first elastic cord has an allowable percent elongation of at least 200 percent.

In another embodiment, the invention provides a retractable bimini top movable between stowed and deployed orientations. The retractable bimini top includes a collapsible frame including a forward main bow, an aft main bow, a forward auxiliary bow coupled to the forward main bow, and an aft auxiliary bow coupled to the aft main bow. A cover of the retractable bimini top is positioned over at least a portion of each of the forward main bow, the forward auxiliary bow, the aft main bow, and the aft auxiliary bow. The cover includes a plurality of sleeves. A first elastic cord extends through a first one of the plurality of sleeves in the cover and has a first end coupled to the forward main bow and a second end coupled to the forward auxiliary bow such that the first elastic cord is under tension at least when the retractable bimini top is in the deployed orientation. A second elastic cord extends through a second one of the plurality of sleeves in the cover and has a first end coupled to the aft main bow and a second end coupled to the aft auxiliary bow such that the second elastic cord is under tension at least when the retractable bimini top is in the deployed orientation. Each of the first and second elastic cords has an allowable percent elongation of at least 200 percent.

In yet another embodiment, the invention provides a retractable bimini top movable between stowed and deployed orientations. The retractable bimini top includes a collapsible frame including a forward main bow, an aft main bow, a forward auxiliary bow coupled to the forward main bow, and an aft auxiliary bow coupled to the aft main bow. A cover of the retractable bimini top is positioned over at least a portion of each of the forward main bow, the forward auxiliary bow, the aft main bow, and the aft auxiliary bow. A first elastic cord has a first end coupled to the forward main bow and a second end coupled to the forward auxiliary bow such that the first elastic cord is under tension at least when the retractable bimini top is in the deployed orientation. A second elastic cord has a first end coupled to the aft main bow and a second end coupled to the aft auxiliary bow such that the second elastic cord is under tension at least when the retractable bimini top is in the deployed orientation. Each of the first and second elastic cords exhibits between about zero percent and about 50 percent elongation in the stowed orientation of the retractable bimini top and exhibits between about 200 percent and about 300 percent elongation in the deployed orientation of the retractable bimini top.

Other aspects of the invention will become apparent by consideration of the detailed description and accompanying drawings.

DETAILED DESCRIPTION

Figure 1:
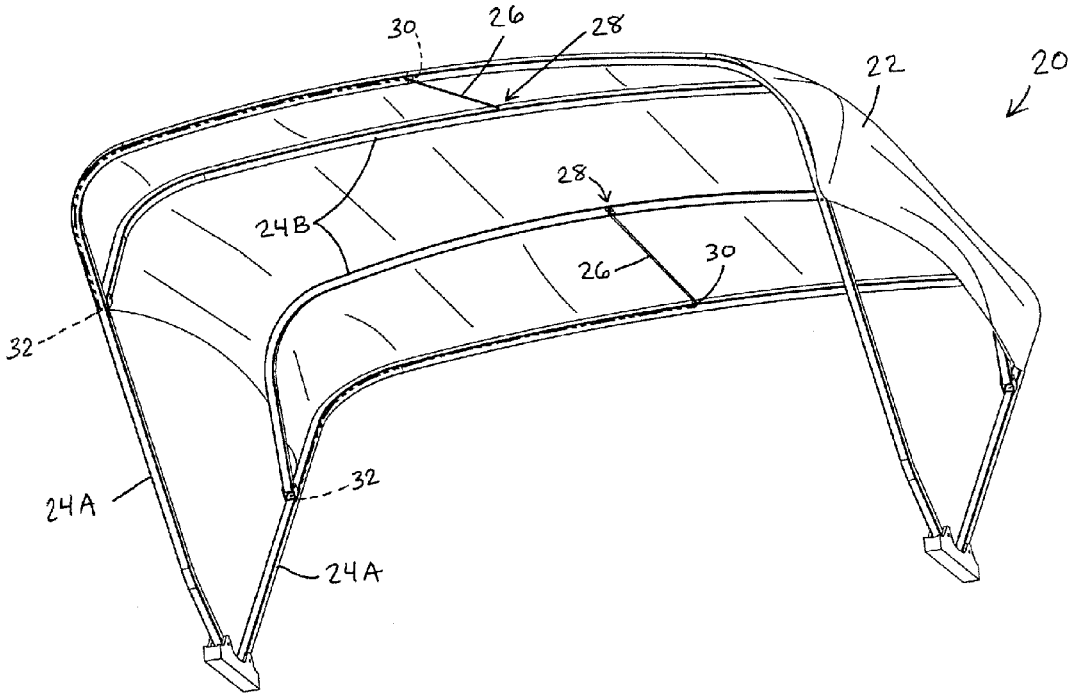
FIGURE 1 (PRIOR ART)
FIG. 1 is a perspective view of a prior art bimini top.
Figure 2:
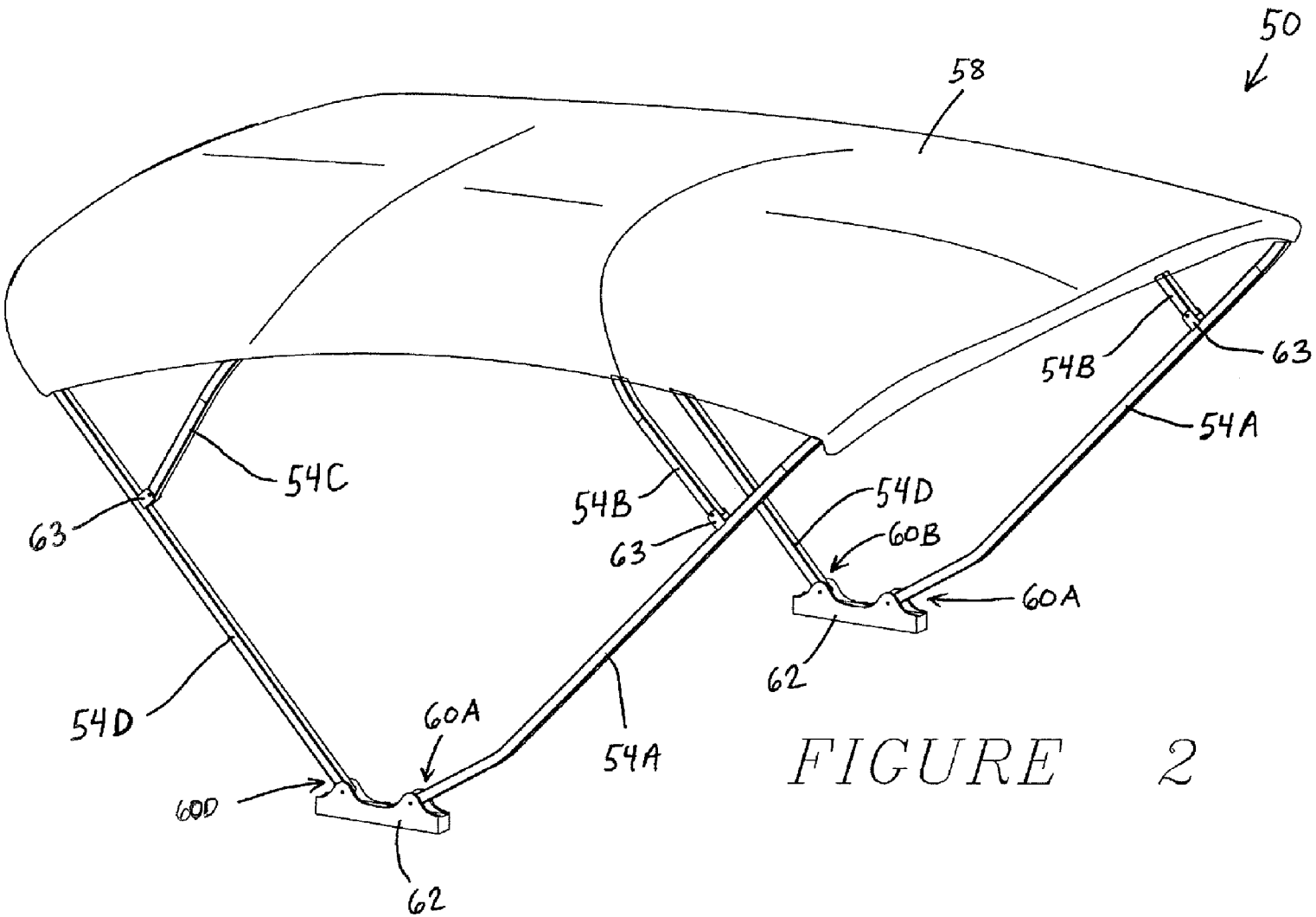
FIG. 2 is a top perspective view of a bimini top according to one embodiment of the invention.

FIG. 2 illustrates a bimini top 50 including a plurality of bows 54A, 54B, 54C, 54D and a cover 58 (e.g., made of fabric, such as canvas and/or one or more other materials that may provide some form of shelter). The bimini top 50 is collapsible as at least one of a pair of main bows 54A, 54D is movable between stowed and deployed orientations. As such, the bimini top 50 as a whole is movable between a stowed orientation (FIG. 3) and a deployed orientation (FIG. 4). In the illustrated construction, a bottom end 60A, 60D of at least one of the main bows 54A, 54D is pivotably mounted to a substrate such as a boat deck (not shown), for example, by a pair of mounts or supports 62. However, one of ordinary skill in the art will appreciate that the main bows 54A, 54D may be mounted and made movable in relation to each other in various ways. During retraction of the bimini top 50 from the deployed orientation to the stowed orientation, the forward main bow 54A is pivoted about its bottom end 60A back towards the aft main bow 54D. As this occurs, the cover 58 loses its tautness and becomes compressed or wrinkled up as the distance between its forward and aft ends is decreased. Also, in order to facilitate a more compact stowed orientation, the forward and aft auxiliary bows 54B, 54C are pivoted about joints 63 on the respective main bows 54A, 54D from the deployed orientation to the stowed orientation.

It should be noted that the bimini top 50 may include more or fewer bows 54 having similar or alternate sizes, shapes, or overall arrangements as the bows 54A-54D illustrated herein. The bimini top 50 may be moved back and forth between the stowed and deployed orientations either manually or automatically (with one or more powered actuators, such as hydraulic actuators).

The bimini top 50 includes an integrated retraction-aiding system. The retraction-aiding system operates to bias the auxiliary bows 54B, 54C towards the respective main bows 54A, 54D during retraction of the bimini top 50 from the deployed orientation to the stowed orientation. When the bimini top 50 is moved into the deployed orientation, the auxiliary bows 54B, 54C deploy or pivot out from the respective main bows 54A, 54D automatically as the main bows 54A, 54D extend away from each other and the cover 58 is stretched taut. However, without dedicated retraction means such as the retraction-aiding system described in greater detail below, one or more of the auxiliary bows 54B, 54C may remain deployed or semi-deployed simply by gravity and/or interference with the cover 58, even when the main bows 54A, 54D are moved together. The retraction-aiding system eliminates the need for manipulating or "stacking" the auxiliary bows 54B, 54C manually, which may otherwise be necessary, even with a powered bimini top 50.

Figure 3:
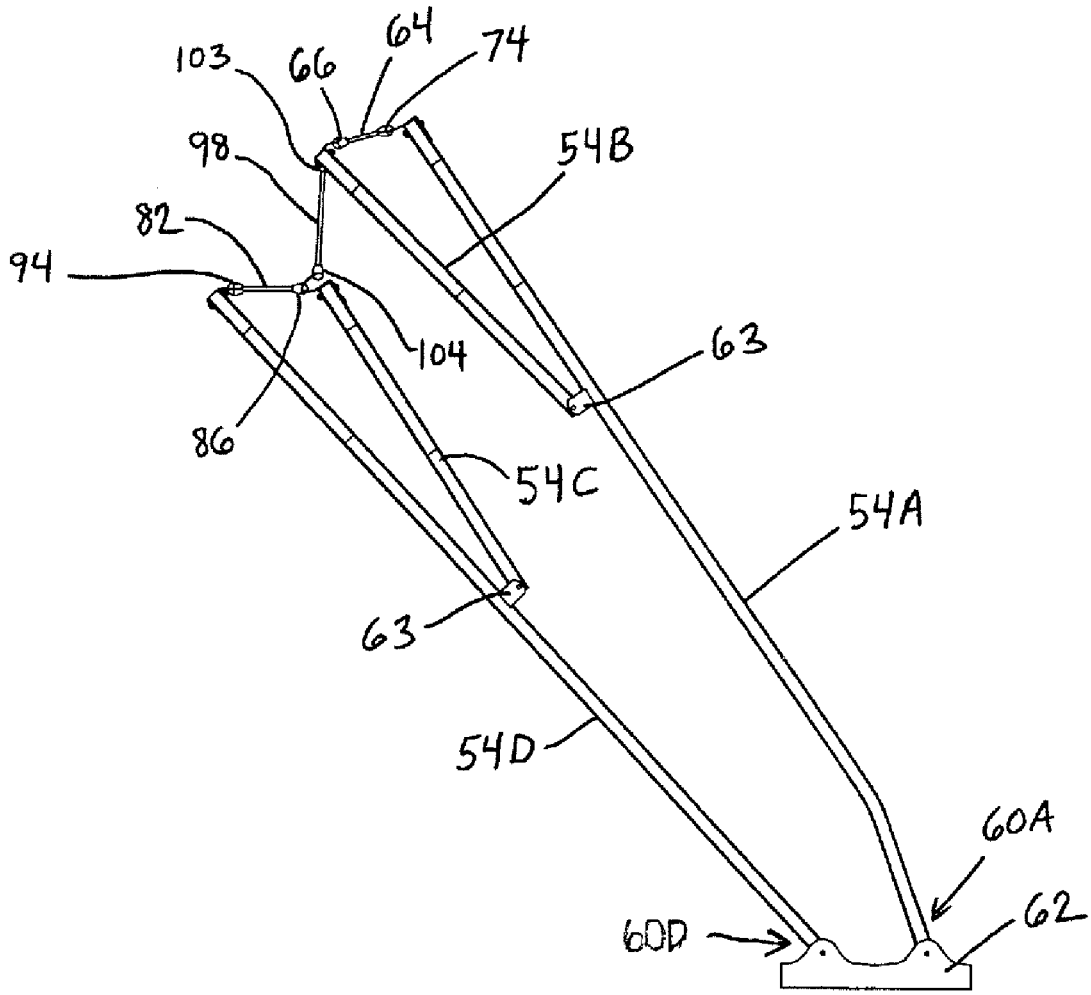
FIG. 3 is a side view of the bimini top of FIG. 2 in a stowed orientation. The cover, shown in FIG. 2, is removed for clarity.
Figure 4:
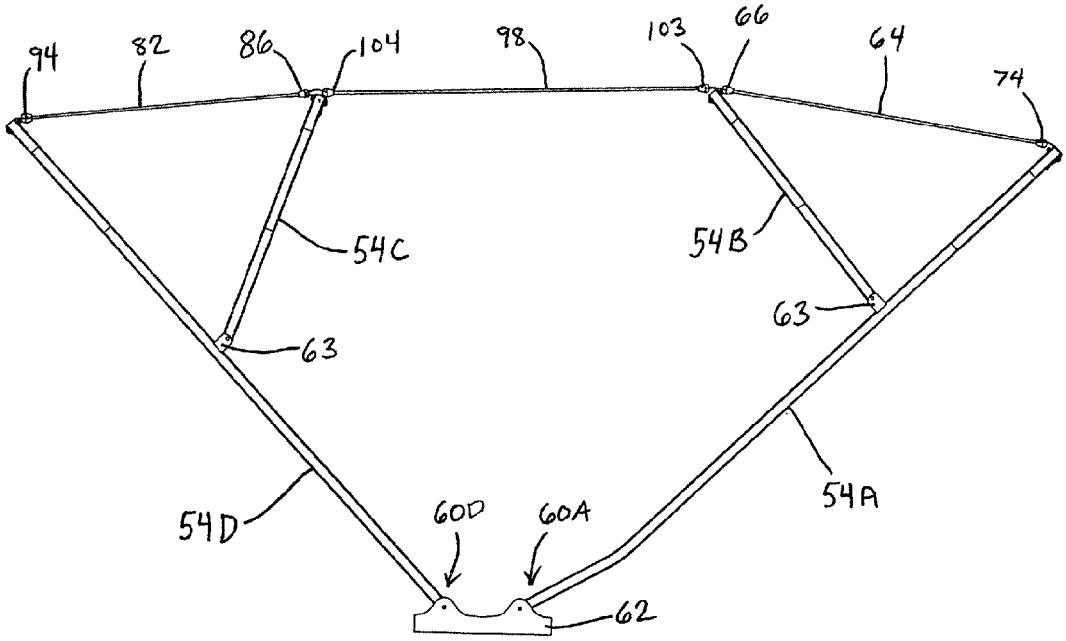
FIG. 4 is a side view of the bimini top of FIG. 2 in a deployed orientation. The cover, shown in FIG. 2, is removed for clarity.
Figure 5:
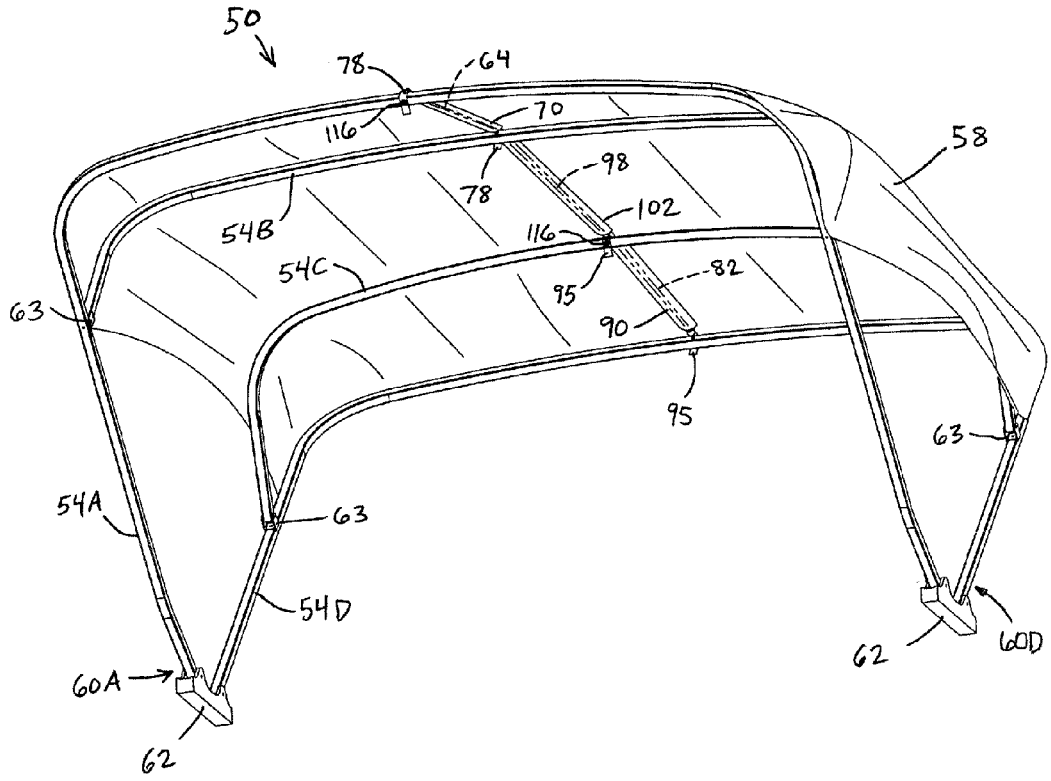
FIG. 5 is a bottom perspective view of the bimini top of FIG. 2.

As shown in at least FIGS. 3-5, a first elastic cord 64 extends between the forward main bow 54A and the forward auxiliary bow 54B. The first elastic cord 64 includes a first end 66 coupled to the forward auxiliary bow 54B and a second end 74 coupled to the forward main bow 54A. The first elastic cord 64 extends from the forward auxiliary bow 54B through a first pocket or sleeve 70 (FIG. 5) of the cover 58 between the bows 54A, 54B. As such, the first elastic cord 64 is substantially entirely enclosed within the sleeve 70 and not exposed to the elements (water spray, UV rays, etc.) or to the occupants below.

When the bimini top 50 is in the deployed orientation (FIGS. 2, 4, 5) and thus, the forward auxiliary bow 54B is pivoted out away from the forward main bow 54A, the first elastic cord 64 exhibits an elongation between about 200 percent (obtaining a length about 3 times its nominal length) and about 300 percent (obtaining a length about 4 times its nominal length). When the bimini top 50 is in the stowed orientation (FIG. 3) and thus, the forward auxiliary bow 54B is in the stowed orientation immediately adjacent the forward main bow 54A, the first elastic cord 64 is relatively unstretched and is in an unstressed or relaxed state. In one construction, the first elastic cord 64 has a nominal length of about 9 inches in the unstressed or relaxed state. Thus, in the stowed orientation (FIG. 3), the first elastic cord 64 is about 9 inches in length. In the deployed orientation (FIGS. 2, 4, 5), the first elastic cord 64 is stretched to about 35 inches in length. In an alternate construction, the first elastic cord 64 has a nominal length of about 11 inches and is stretched to about 40 inches in the deployed orientation of the bimini top 50. In some constructions, the first elastic cord 64 may be stretched slightly in the stowed orientation of the bimini top 50, for example between about zero percent elongation and about 50 percent elongation (1-1.5 times its nominal length).

In one construction, the first elastic cord 64 is constructed of hollow latex tubing having a maximum allowable elongation of at least about 200 percent (stretching to a length about 3 times its original length). In the illustrated construction, the first elastic cord 64 has a maximum allowable elongation of at least about 300 percent (stretching to a length about 4 times its original length) and a tensile spring coefficient of about 1.4 pounds per foot, which is maintained substantially constant even above 200 percent elongation. In some constructions, the first elastic cord 64 maintains a substantially constant tensile spring coefficient throughout substantially the entire range of allowable elongation. In some constructions, the first elastic cord 64 is constructed of mandrel-dipped latex having one or more concentric layers formed by multiple dipping operations, as opposed to an extrusion process.

Figure 6:
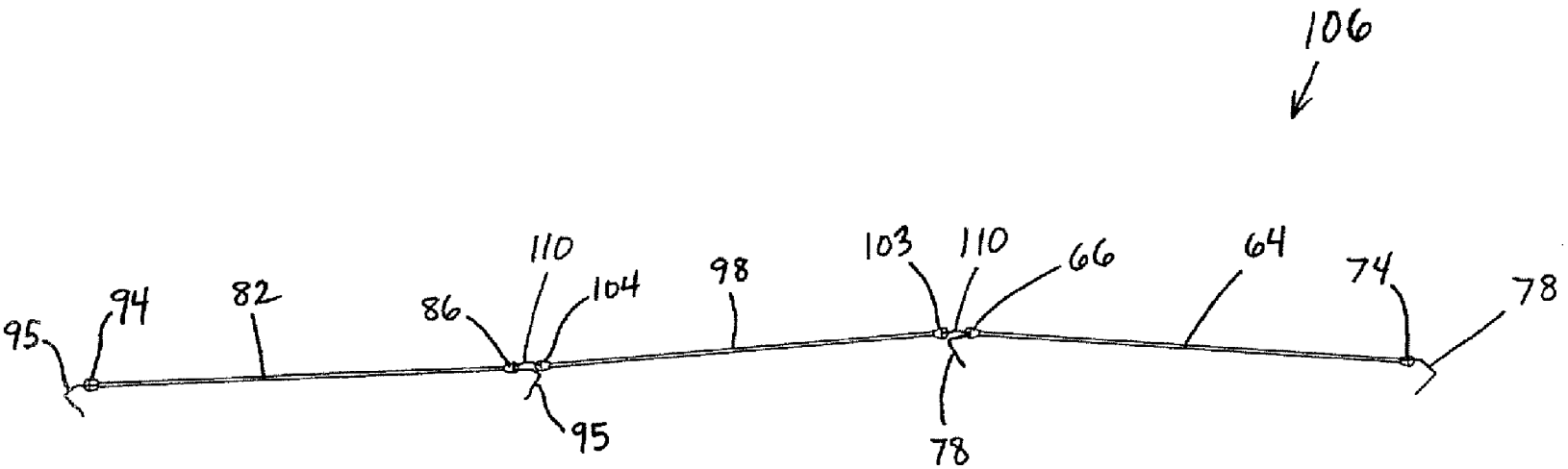
FIG. 6 is a side view of three elastic cords of the bimini top of FIG. 2.
Figure 7:
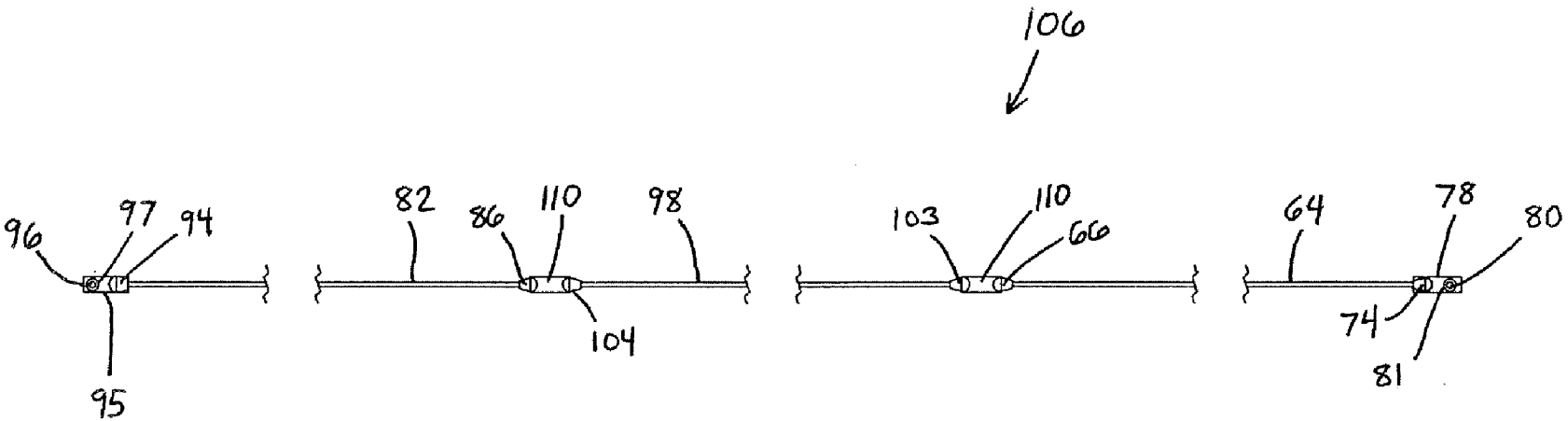
FIG. 7 is a top view of the three elastic cords shown in FIG. 6.

As shown in FIGS. 6 and 7, end connectors 78 are coupled to the ends 66, 74 of the first elastic cord 64 and provide material for coupling the first elastic cord 64 to both of the forward bows 54A, 54B. The end connectors 78 are constructed of substantially robust, relatively non-stretchable material (as compared to the first elastic cord 64 itself). In some constructions, the end connectors 78 are woven nylon. In the illustrated construction, the end connectors 78 are substantially flat tabs, each having an opening 80 at least partially defined by a grommet 81 (FIG. 7).

As shown in at least FIGS. 3-5, a second elastic cord 82 extends between the aft main bow 54D and the aft auxiliary bow 54C. Except for the connection locations, the second elastic cord 82 is substantially identical to the first elastic cord 64. A first end 86 of the second elastic cord 82 is coupled to the aft auxiliary bow 54C and extends through a pocket or sleeve 90 (FIG. 5) in the cover 58 towards the aft main bow 54D. The second elastic cord 82 includes a second end 94 coupled to the aft main bow 54D. The arrangement of the second elastic cord 82 between the aft bows 54C, 54D is essentially a mirror image of the arrangement of the first elastic cord 64 between the forward bows 54A, 54B. End connectors 95 couple the second elastic cord 82 to both of the aft bows 54C, 54D. The end connectors 95 are similar to the end connectors 78 coupled to the ends of the first elastic cord 64 and each include an opening 96 at least partially defined by a grommet 97.

The material properties of the second elastic cord 82 are substantially identical to that of the first elastic cord 64 described above. In the illustrated construction, the nominal and deployed lengths of the second elastic cord 82 are substantially identical to that of the first elastic cord 64. Thus, the second elastic cord 82 has a nominal length of about 9 inches and a length of about 35 inches in the deployed orientation of the bimini top 50. As described in further detail below, the second elastic cord 82 may be stretched a relatively small amount when the bimini top 50 is in the stowed orientation, as shown in FIG. 3.

As shown in the figures and described above, the first and second elastic cords 64, 82 are similar or substantially identical in many respects and both are positioned along a longitudinal centerline of the bimini top 50. However, variations from this particular configuration are optional. For example, a different arrangement of bows may require the first and second elastic cords 64, 82 to have different lengths or be positioned differently within the bimini top 50. Also, multiple sets of elastic cords 64, 82 may be employed.

In addition to the first and second elastic cords 64, 82, a third elastic cord 98 extends between the forward auxiliary bow 54B and the aft auxiliary bow 54C. As with the first and second elastic cords 64, 82, the third elastic cord 98 is positioned substantially entirely within a pocket or sleeve 102 (FIG. 5) in the cover 58. The third elastic cord 98 is stretched out between the forward and aft auxiliary bows 54B, 54C when the bimini top 50 is in the deployed orientation such that the tension in the third elastic cord 98 acts on the forward and aft auxiliary bows 54B, 54C in order to counteract or fully offset (i.e., equalize) the loads exerted on the forward and aft auxiliary bows 54B, 54C by the first and second elastic cords 64, 82. The third elastic cord 98 has a first end 103 coupled to the forward auxiliary bow 54B and a second end 104 coupled to the aft auxiliary bow 54C.

As shown in FIGS. 6 and 7, the elastic cords 64, 82, 98 are provided as a single interconnected elastic cord unit 106 in one construction. In addition to the end connectors 78, 95 that couple the first and second elastic cords 64, 82 to the bows 54, two additional end connectors 110 are provided to couple the third elastic cord 98 to both the first and second elastic cords 64, 82. The end connectors 110 are similar to the end connectors 78, 95 except that they do not include openings and/or grommets. In effect, the third elastic cord 98 is coupled to both the auxiliary bows 54B, 54C by way of being connected to the respective ends 66, 86 of the first and second elastic cords 64, 82, which are directly coupled to the auxiliary bows 54B, 54C by the respective end connectors 78, 95. In other constructions the elastic cords 64, 82, 98 may or may not be provided as an interconnected unit, and the third elastic cord 98 may be provided with end connectors that are attached to the auxiliary bows 54B, 54C separately from the end connectors 78, 95 of the first and second elastic cords 64, 82.

Figure 8:
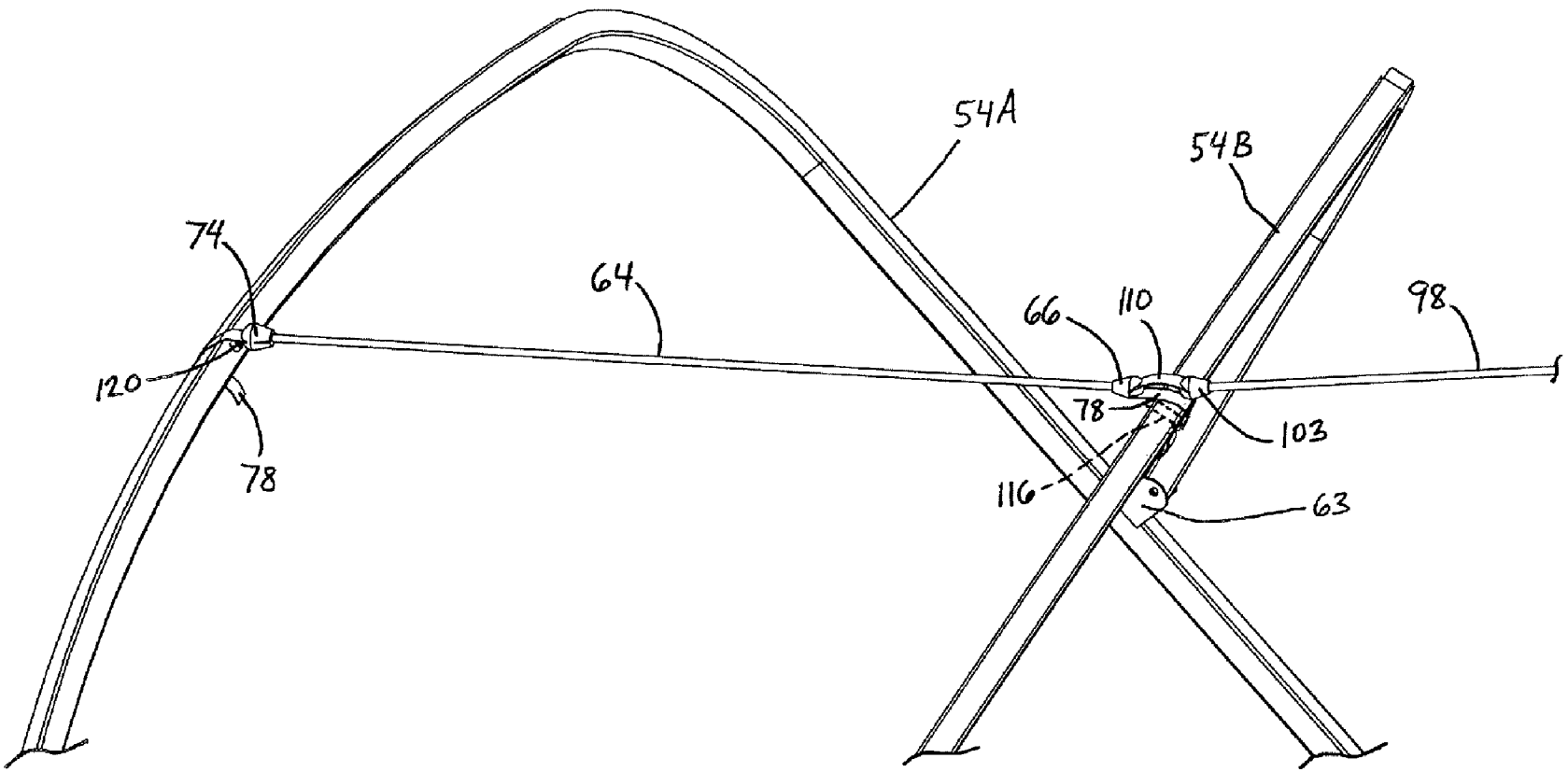
FIG. 8 is a detailed perspective view of the bimini top of FIG. 2, illustrating the attachment of elastic cords thereto. The cover, shown in FIG. 2, is removed for clarity.

In order to couple the elastic cords 64, 82, 98 (and the interconnected elastic cord unit 106 as a whole) to the bows 54A-54D, screws 116 (FIGS. 5 and 8) are inserted through the openings 80, 96 of the four end connectors 78, 95, passed through corresponding openings in the respective bows 54A-54D, and tightened with corresponding nuts 120 (one shown in FIG. 8). Alternate fastening means (e.g., rivets, knots, clips, snaps, etc.) are used in place of the screws 116 and nuts 120 in some constructions.

Each of the first and second elastic cords has a percent elongation between about zero percent and about 50 percent (1-1.5 times its nominal length) in the stowed orientation of the bimini top and has a percent elongation of at least 200 percent (3 times its nominal length), and in some constructions, about 300 percent (4 times its nominal length) in the deployed orientation of the bimini top 50.

As shown in FIG. 3, the bimini top 50 of the illustrated construction is stowed towards the aft main bow 54D such that the first elastic cord 64 acts primarily against gravity at all times to urge the forward auxiliary bow 54B towards the forward main bow 54A. On the contrary, the second elastic cord 82 functions similar to an over-center spring, working against gravity only until the aft auxiliary bow 54C crosses through a vertical plane. Once the aft auxiliary bow 54C crosses through the vertical plane, the second elastic cord 82 and gravity are both working together to urge the aft auxiliary bow 54C towards the aft main bow 54D. The forward auxiliary bow 54B, on the other hand, does not cross through a vertical plane during movement back and forth between the stowed and deployed orientations. In some constructions, the joints 63 limit the amount of allowable movement of the auxiliary bows 54B, 54C relative to the respective main bows 54A, 54D.

Thus, the invention provides, among other things, an easily-assembled and long-lasting retraction aiding system for a bimini top in which at least one elastic cord with a large allowable elongation is utilized and is substantially enclosed within a portion of a cover of the bimini top. Various features and advantages of the invention are set forth in the following claims.

What is claimed is:

1. A retractable bimini top movable between stowed and deployed orientations, the retractable bimini top comprising:

a frame including a first bow and a second bow movable relative to the first bow;

a cover positioned over at least a portion of each of the first and second bows;

a first elastic cord having a first end coupled to the first bow and a second end coupled to the second bow such that the first elastic cord is under tension at least when the retractable bimini top is in the deployed orientation;

a third bow;

a fourth bow movable relative to the third bow, wherein the third and fourth bows are movable towards the first and second bows during stowing and are movable away from the first and second bows during deployment of the retractable bimini top;

a second elastic cord having a first end coupled to the third bow and a second end coupled to the fourth bow such that the second elastic cord is under tension at least when the retractable bimini top is in the deployed orientation; and a third elastic cord having a first end coupled to the second bow and a second end coupled to the fourth bow;

wherein the first elastic cord has an allowable percent elongation of at least 200 percent.

2. The retractable bimini top of claim 1, wherein the second bow is an auxiliary bow supported by and movable relative to the first bow, and wherein the fourth bow is an auxiliary bow supported by and movable relative to the third bow.

3. The retractable bimini top of claim 1, wherein the cover includes a first fabric sleeve and a second fabric sleeve, the first and second elastic cords being positioned inside the first and second fabric sleeves, respectively.

4. The retractable bimini top of claim 1, wherein each of the first and second elastic cords are latex.

5. The retractable bimini top of claim 4, wherein each of the first and second elastic cords are formed by mandrel-dipping.

6. The retractable bimini top of claim 4, wherein each of the first and second elastic cords includes a first nylon end connector and a second nylon end connector for coupling the first and second elastic cords to the respective bows.

7. A retractable bimini top movable between stowed and deployed orientations, the retractable bimini top comprising:

a collapsible frame including a forward main bow, an aft main bow, a forward auxiliary bow coupled to the forward main bow, and an aft auxiliary bow coupled to the aft main bow;

a cover positioned over at least a portion of each of the forward main bow, the forward auxiliary bow, the aft main bow, and the aft auxiliary bow, the cover including a plurality of sleeves;

a first elastic cord extending through a first one of the plurality of sleeves in the cover and having a first end coupled to the forward main bow and a second end coupled to the forward auxiliary bow such that the first elastic cord is under tension at least when the retractable bimini top is in the deployed orientation;

a second elastic cord extending through a second one of the plurality of sleeves in the cover and having a first end coupled to the aft main bow and a second end coupled to the aft auxiliary bow such that the second elastic cord is under tension at least when the retractable bimini top is in the deployed orientation; and a third elastic cord having a first end coupled to the forward auxiliary bow and a second end coupled to the aft auxiliary bow, the third elastic cord extending through a third one of the plurality of sleeves in the cover, wherein each of the first and second elastic cords has an allowable percent elongation of at least 200 percent.

8. The retractable bimini top of claim 7, wherein the forward auxiliary bow and the aft auxiliary bow are positioned generally between the forward main bow and the aft main bow.

9. The retractable bimini top of claim 7, wherein the third elastic cord is constructed of a material having substantially identical material properties as the first and second elastic cords.

10. The retractable bimini top of claim 7, wherein the first and second elastic cords are latex.

11. The retractable bimini top of claim 10, wherein each of the first and second elastic cords includes a first nylon end connector and a second nylon end connector for coupling the first and second elastic cords to the respective bows.

12. The retractable bimini top of claim 10, wherein the first and second elastic cords are formed by mandrel-dipping.

* * * * *